US005611321A

United States Patent [19]

Hoeting et al.

[11] Patent Number: 5,611,321

[45] Date of Patent: Mar. 18, 1997

[54] BALL LAUNCHING DEVICE

[75] Inventors: Michael G. Hoeting; Sean T. Mullaney, both of Cincinnati, Ohio

[73] Assignee: Bang Zoom Design, Inc., Cincinnati, Ohio

[21] Appl. No.: 464,004

[22] Filed: May 18, 1995

[51] Int. Cl.[6] ..... F41B 4/00

[52] U.S. Cl. ..... 124/6; 124/79

[58] Field of Search ..... 124/4, 6, 78, 79

[56] References Cited

U.S. PATENT DOCUMENTS

| | | | |
|---|---|---|---|
| 1,211,738 | 1/1917 | Marty | 124/6 |
| 2,477,308 | 7/1949 | Malkan | 124/79 |
| 2,989,045 | 6/1961 | Hodge et al. . | |
| 3,548,801 | 12/1970 | Lohr | 124/6 |
| 3,995,859 | 12/1976 | Goldfarb et al. . | |
| 4,080,950 | 3/1978 | Paulson et al. | 124/1 |
| 4,705,014 | 11/1987 | Kahelin | 124/6 X |
| 5,417,196 | 5/1995 | Morrison et al. | 124/6 |
| 5,471,967 | 12/1995 | Matsuzaki et al. | 124/6 |

FOREIGN PATENT DOCUMENTS

| | | | |
|---|---|---|---|
| 4021282 | 10/1991 | Germany | 124/6 |

*Primary Examiner*—John A. Ricci
*Attorney, Agent, or Firm*—Kurt R. Benson

[57] ABSTRACT

A device for launching soft foam balls includes a launcher body, a launching wheel having a circumferential gripping surface thereon and a restriction in the launcher body for urging a soft foam ball into compressed engagement with the launching wheel. The device further includes a manually operable rack gear assembly for rapidly rotating the launching wheel and a feed assembly for individually releasing foam balls so that they contact the launching wheel for launching them from the launcher body in rapid succession.

9 Claims, 6 Drawing Sheets

BALL LAUNCHING DEVICE

BACKGROUND AND SUMMARY OF THE INVENTION

The instant invention relates to ball launching devices, and more particularly to a ball launching device of the general type in which a ball is accelerated by contacting the circumferential surface of a rapidly rotating launching wheel.

It has generally been found that devices which are operative for launching balls and the like have significant levels of appeal. In this regard, various types of "pitching machine" devices which are operative for launching balls at relatively high rates of speed have been heretofore available. Devices of this type are disclosed in the U.S. Patents to Hodge et al., U.S. Pat. No. 2,989,045; Paulson et al., U.S. Pat. No. 4,080,950; and Kahelin, U.S. Pat. No. 4,705,014. Another more generally related ball launching device is disclosed in the U.S. Patent to Goldfarb et al., U.S. Pat. No. 3,995,859. For the most part, however, the heretofore available pitching devices, such as those disclosed in the U.S. Patents to Paulson et al. and Kahelin, use launching wheels having at least partially compressible outer gripping surfaces thereon that are primarily adapted for launching noncompressible balls, such as baseballs. Further, most of the heretofore available ball pitching-type apparatus have not been adapted for convenient manual handheld operation, it being noted that both the Kahelin and Paulson et al. devices include electric motors for rotating the respective launching wheels thereof.

The instant invention provides an effective new ball launching device which is effectively adapted for manual handheld operation for launching a plurality of balls in rapid sequence. Further, the ball launching device of the instant invention is adapted specifically for use in launching relatively soft, lightweight compressible foam balls, and therefore, the ball launching device can effectively utilize a substantially rigid noncompressible launching wheel for gripping and accelerating balls in order to launch them from the device. Still further, the ball launching device of the instant invention is adapted so that the launching wheel thereof is effectively manually rotatable at a relatively high rate of rotation for launching foam balls from the device. Even still further, the device of the instant invention is specifically adapted for use in launching relatively soft, lightweight foam balls which inherently have a high degree of safety even when they are intentionally or inadvertently launched in the direction of another participant in game play.

More specifically, the ball launching device of the instant invention comprises at least one spherical soft foam ball having a predetermined diameter, a launcher body having a launching passage therein which has a slightly greater diameter than the ball, and a launching wheel having a circumferential gripping surface thereon which extends into the passage. The ball launching device further includes a restriction in the form of a compression finger which extends into the passage at a location which is substantially opposite from the launching wheel. The compression finger terminates at an inner end which is spaced from the gripping surface of the launching wheel by a distance which is slightly less than the diameter of the ball, and the device further includes a manually operable rack gear assembly for rotating the launching wheel at a high rate of rotation so that the portion of the launching wheel which extends into the launching passage travels in a direction toward the muzzle end of the launching passage. The device still further includes a feeding tube assembly which is operative for feeding a ball to the passage so that when the launching wheel is rotated, the ball passes between the launching wheel and the compression finger causing it to be slightly compressed therebetween and urged into frictional engagement with the launching wheel and thereby causing it to be launched from the passage through the muzzle end thereof. The rack gear assembly preferably includes an elongated rack gear which is manually operable by repeatedly reciprocally pulling it rearwardly and returning it in a forward direction for increasingly rotating the launching wheel. The body of the device preferably includes a pistol grip handle portion for enabling a user to hold the device in a pistol-like manner with the muzzle end of the launching passage facing generally away from the user. The feeding tube assembly preferably includes a trigger which is positioned adjacent the handle and manually operable for releasing balls so that they pass into the passage. The device preferably includes a plurality of balls, and the launching tube is preferably adapted to function as a magazine containing a plurality of balls which can be sequentially fed to the launching wheel by repeatedly manipulating the trigger. Accordingly, once the launching wheel has been sufficiently rotated by manipulating the rack gear assembly, it is possible to manipulate the trigger to sequentially launch a plurality of balls from the device in relatively rapid succession.

It has been found that the ball launching device of the instant invention can be effectively utilized for rapidly launching a plurality of relatively soft, safe, foam balls in rapid succession. Specifically, by assembling a plurality of balls in the feeding tube and then reciprocally operating the rack gear for rapidly rotating the launching wheel, it is possible to launch balls from the device by manipulating the trigger so that individual balls pass between the compression finger and the launching wheel whereby they are individually compressed against the launching wheel and rapidly accelerated in order to individually launch them through the muzzle end of the launching passage. Further, because the device is adapted for use with soft, safe foam balls, a relatively small amount of inertia is required to launch each ball so that a plurality of balls can be launched without restoring the rotational inertia of the launching wheel.

Accordingly, it is a primary object of the instant invention to provide an effective launching device for launching a plurality of relatively soft, safe, foam balls in rapid succession.

Another object of the instant invention is to provide an effective ball launching device which is operative for launching compressible foam balls utilizing a relatively rigid launching wheel.

An even still further object of the instant invention is to provide a handheld launching device for launching relatively soft, safe, foam balls in rapid succession.

An even still further object of the instant invention is to provide an effective ball launching device which includes a rack gear for manually rotating a ball launching wheel.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
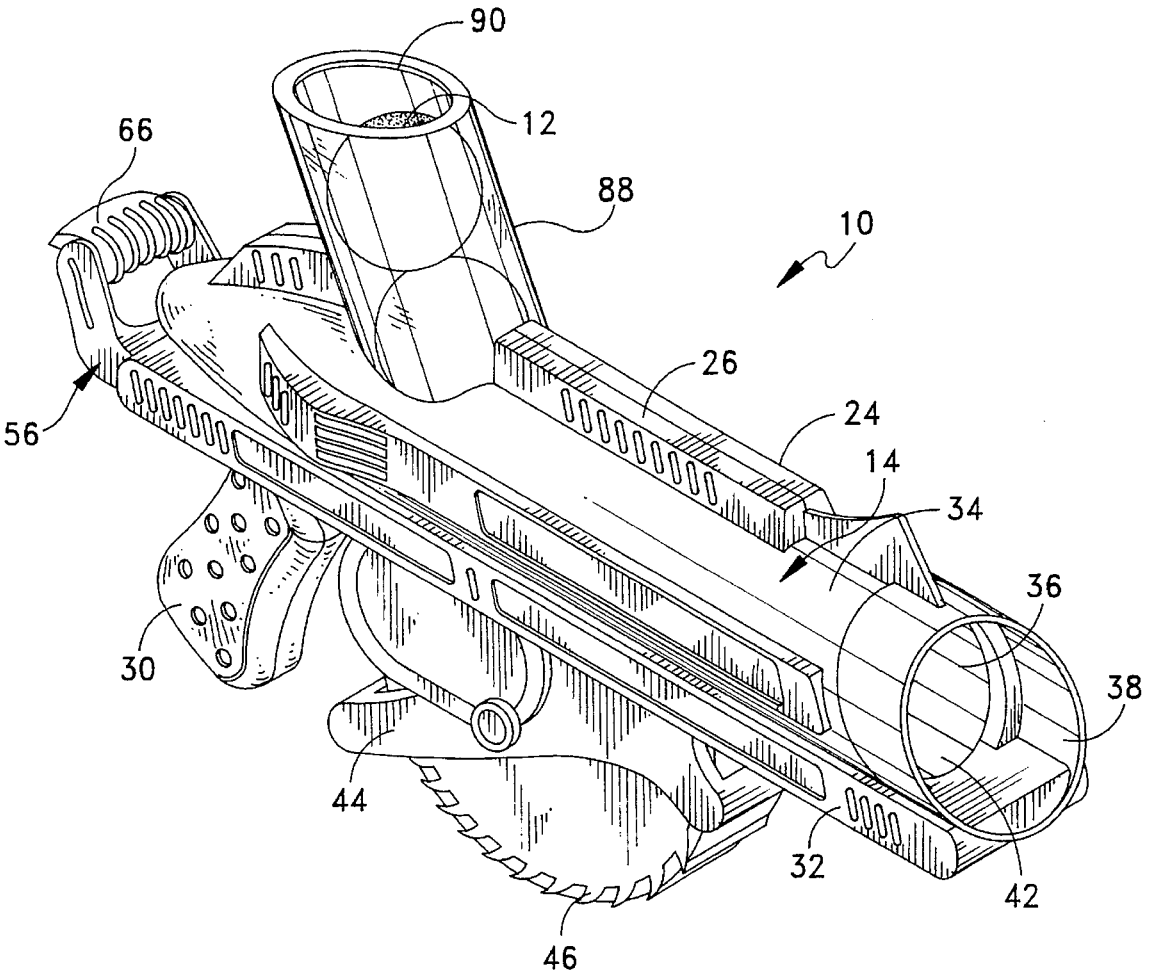
FIG. 1 is a perspective view of the ball launching device of the instant invention.
Figure 2:
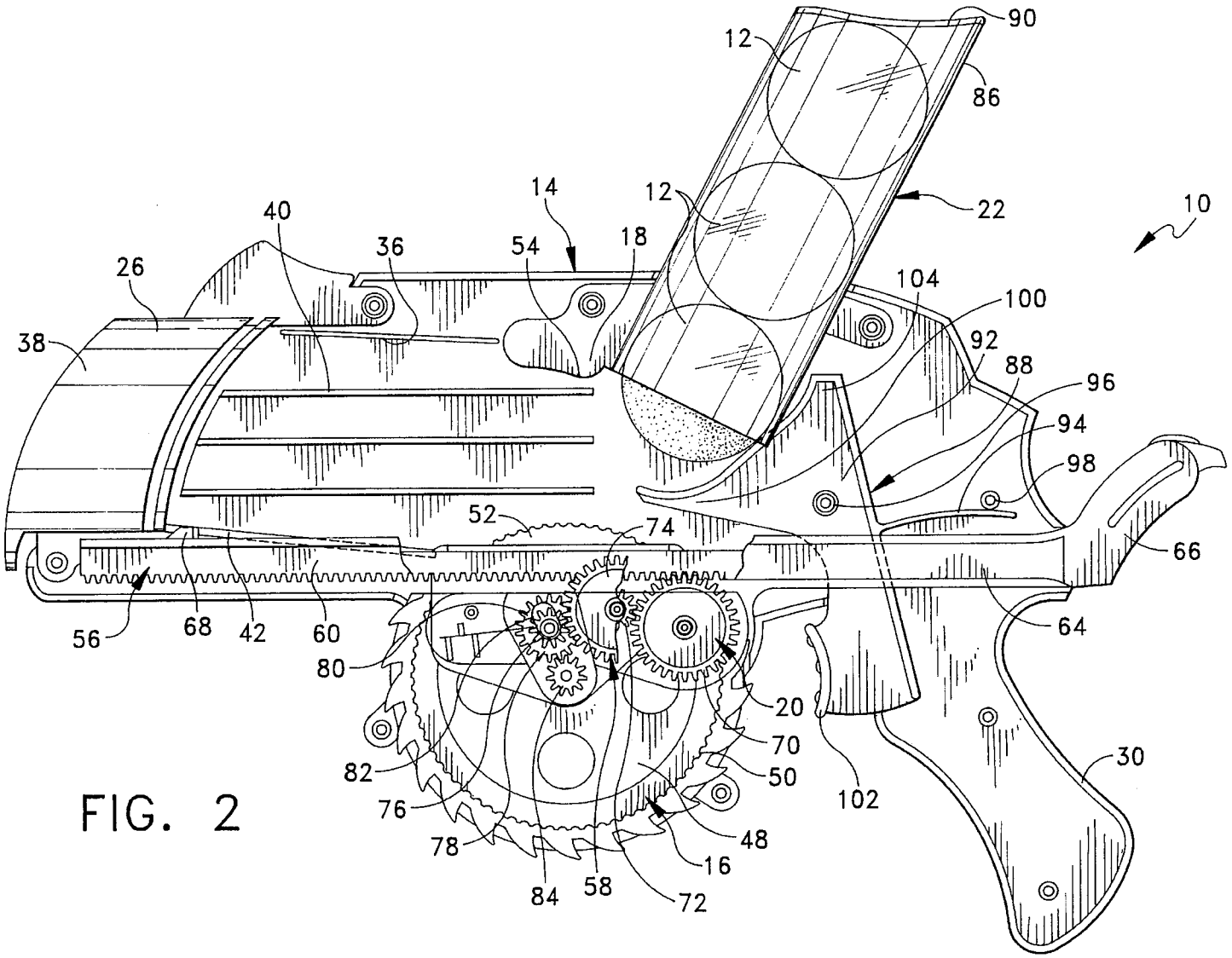
FIG. 2 is a side elevational view thereof with one of the housing sections removed.
Figure 3:
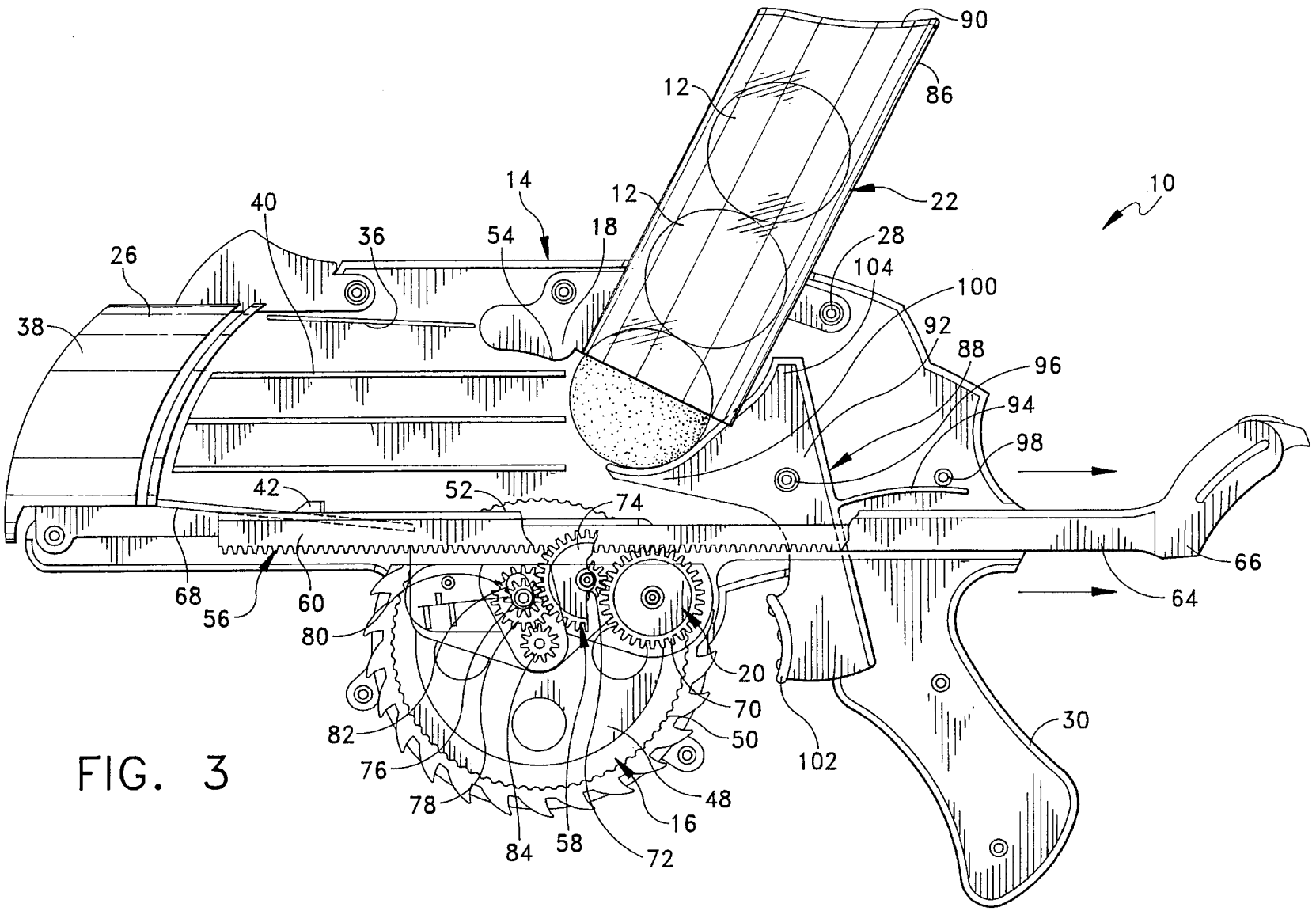
FIG. 3 is a similar side elevational view illustrating the operation of the rack gear assembly as the rack gear is pulled rearwardly.
Figure 5:
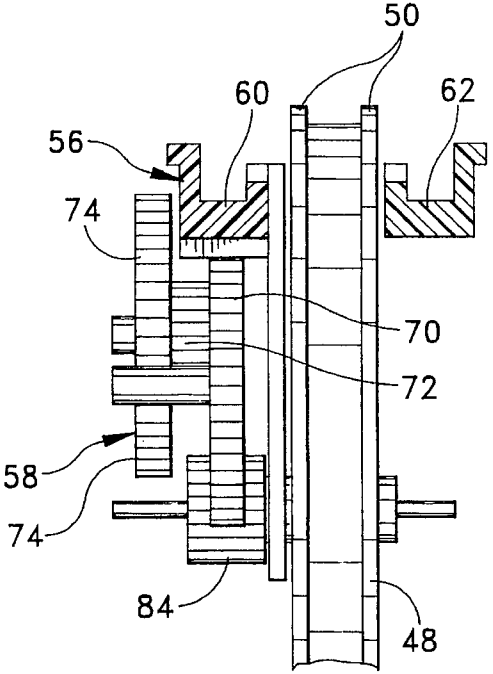
FIG. 5 is a sectional view taken along line 5—5 in FIG. 4.

Referring now to the drawings, the ball launching device of the instant invention is illustrated in FIGS. 1 through 7 and generally indicated at 10 in FIGS. 1, 2, 3 and 7. The ball launching device 10 comprises a plurality of soft, foam balls 12, a housing or body portion generally indicated at 14, a launching wheel generally indicated at 16, and a restriction element 18. The device 10 further comprises a rack gear assembly 20 and a feed assembly 22. During operation of the ball launching device 10, the rack gear assembly 20 is operative for rotating the launching wheel 16, and the feed assembly 20 is operative for releasably guiding the individual balls 12 so that they pass between the restriction 18 and the launching wheel 16 so that inertia is transferred from the launching wheel 16 to the individual balls 12 causing them to be individually launched from the housing 14. In this regard, the restriction 18 is operative for individually urging the balls 12 into compressed engagement with the launching wheel 16 so that momentum from the launching wheel 16 can be more effectively transferred to the balls 12 for individually launching them from the housing 14.

The balls 12 preferably comprise relatively soft, lightweight, compressible foam balls having a predetermined diameter. Accordingly, the balls 12 can be launched from the device 10 with a relatively small amount of inertial energy, and because of their relatively soft, lightweight nature, they can normally be effectively launched from the device 10 without concern for the safety of persons who are struck by the launched balls 12.

The housing 14 includes first and second housing sections 24 and 26, respectively, which are secured together with a plurality of screws 28 so that they cooperate to define a launcher body having a futuristic pistol-like configuration. The housing 14 includes a handle portion 30, a rack gear trackway section 32 and a main barrel section 34 having an inner passageway 36 formed therein. The inner passageway 36 is formed immediately above the rack gear trackway section 32, and it includes a muzzle end 38. The inner passageway 36 has a plurality of longitudinally extending ribs 40 formed therein, and it includes a guide plate 42 which extends from a point adjacent the launching wheel 16 to the muzzle end 38. The inner passageway 36 has a diameter which is slightly greater than the diameter of the balls 12, so that the balls 12 can freely pass therethrough after leaving the launching wheel 16. The housing 14 further includes a rack gear assembly housing section 44 which cooperates with the rack gear trackway 32 for housing the rack gear assembly 20 as will hereinafter be more fully set forth.

The launching wheel 16 includes a launching wheel housing 46 which depends from the rack gear assembly housing 44 and a launching wheel element 48 having an outer circumferential gripping surface 50 thereon of generally irregular configuration. The launching wheel 16 is mounted in the rack gear assembly housing 44 so that an upper portion 52 of the launching wheel 16 extends slightly into the passageway 36 in the barrel portion 34 as illustrated most clearly in FIGS. 2, 3 and 7. The launching wheel 16 is adapted for rotation in the direction indicated in FIGS. 4, 6 and 7 so that the portion 52 which extends into the passage 36 travels generally in the direction of the muzzle end 38.

The restriction or compression finger 18 comprises a rib-like member which projects inwardly into the passageway 36 terminating in a rounded inner end 54. The inner end 54 is spaced from the gripping surface 50 on the launching wheel 16 by a distance which is slightly smaller than the diameter of the balls 12. As a result, as sequential balls 12 are contacted by the gripping surface 50 and advanced toward the muzzle end 38 of the passage 36, the rounded inner end 54 operates to individually compress the balls 12 slightly as they pass between the compression finger 18 and the gripping surface 50 causing the individual balls 12 to be urged into slightly biased engagement with the wheel 16, so that they are more effectively accelerated by the wheel 16 as they pass through the initial portion of the passage 36. However, because the end 54 is formed in a rounded configuration, the sequential balls 12 can nevertheless easily pass between the compression finger 18 and the wheel 16 so that they are individually launched from the device 10.

The rack gear assembly 20 comprises a rack gear element generally indicated at 56, which is mounted in the rack gear trackway section 32; and a pinion gear assembly generally indicated at 58, which is mounted in the rack gear assembly housing 44. The rack gear element 56 comprises an elongated bifurcated member including a first or rack gear leg 60 and a guide leg 62 which are connected at a rear end section 64. An operating handle 66 extends rearwardly from the end section 64 so that it is positioned at the rear of the housing 14 for drawing the rack gear 56 rearwardly in the trackway section 32. The trackway section 32 is adapted for mounting the rack gear element 56 therein so that the rack gear element 56 is longitudinally slidable in the trackway section 32 but so that the rack gear element 56 is nevertheless prevented from being completely withdrawn from the housing 14. In this regard, the rack gear element 56 includes stop elements 68 on both of the legs 60 and 62 thereof which are engageable with the rear portion of the trackway section 32 to prevent the rack gear element 56 from being completely withdrawn from the housing 14.

Figure 4:
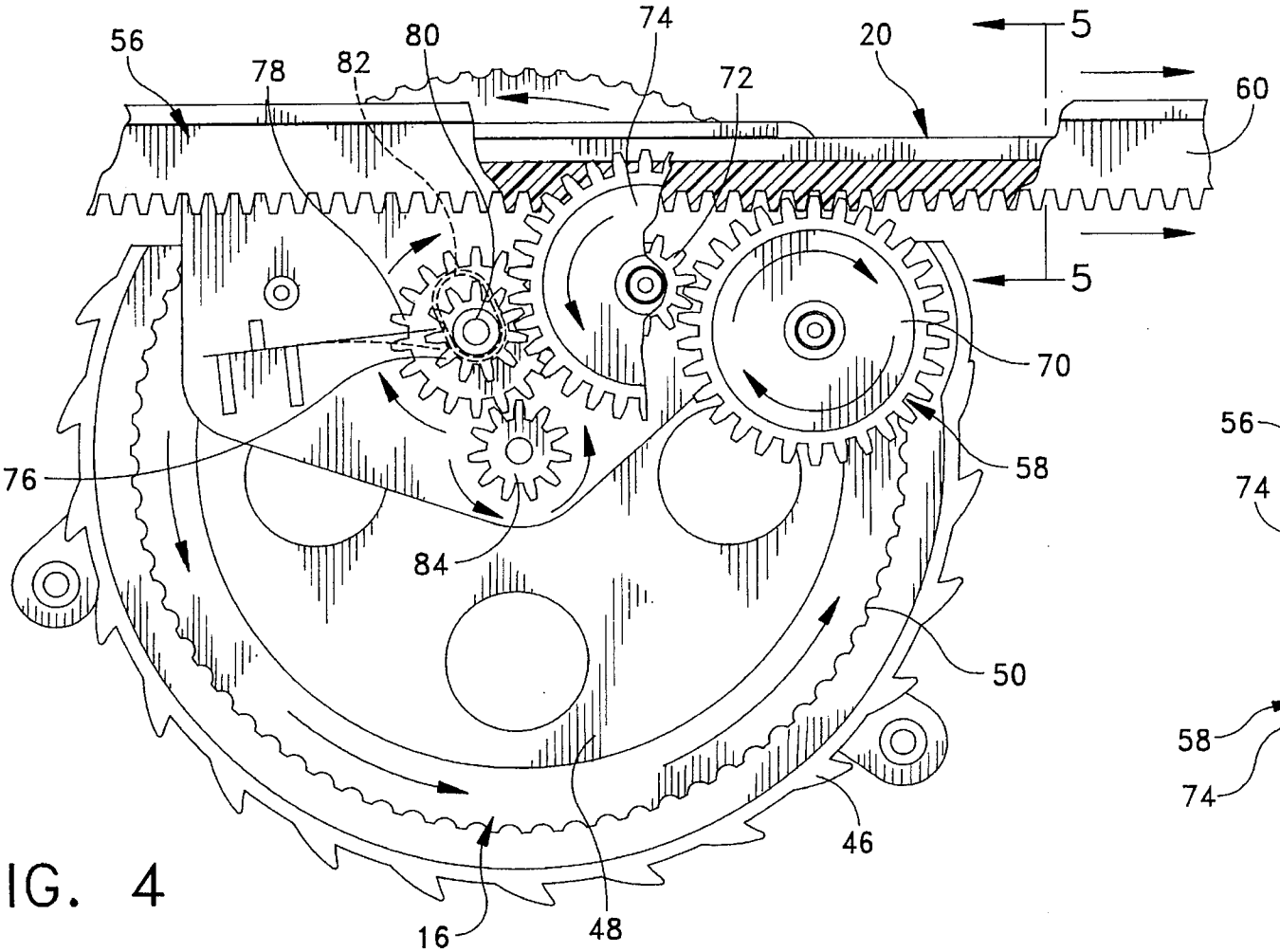
FIG. 4 is an enlarged side elevational view of the rack gear assembly shown in partial section as the rack gear is pulled rearwardly.
Figure 6:
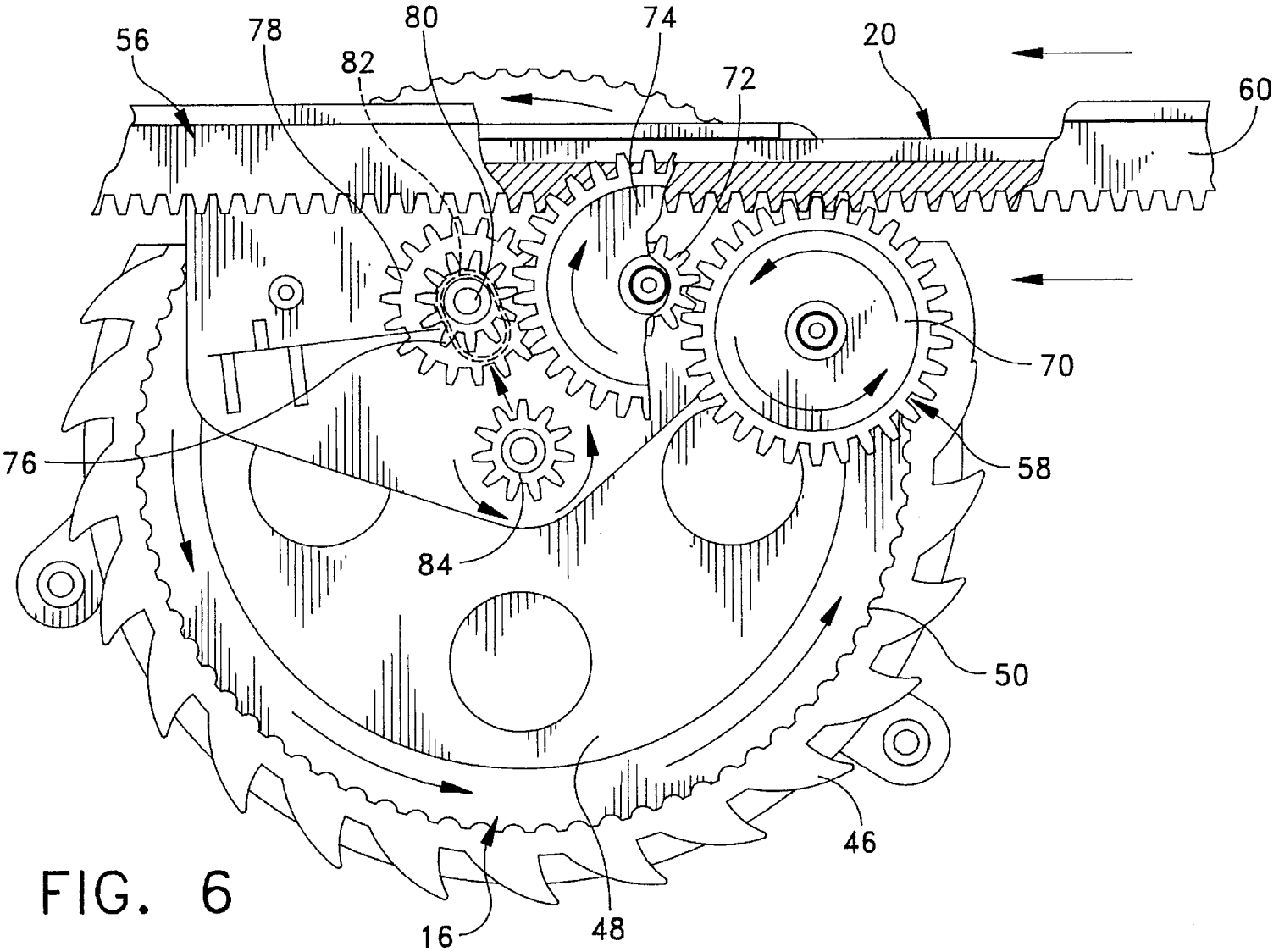
FIG. 6 is an enlarged side elevational view of the rack gear assembly shown in partial section as the rack gear is returned to a forward position.
Figure 7:
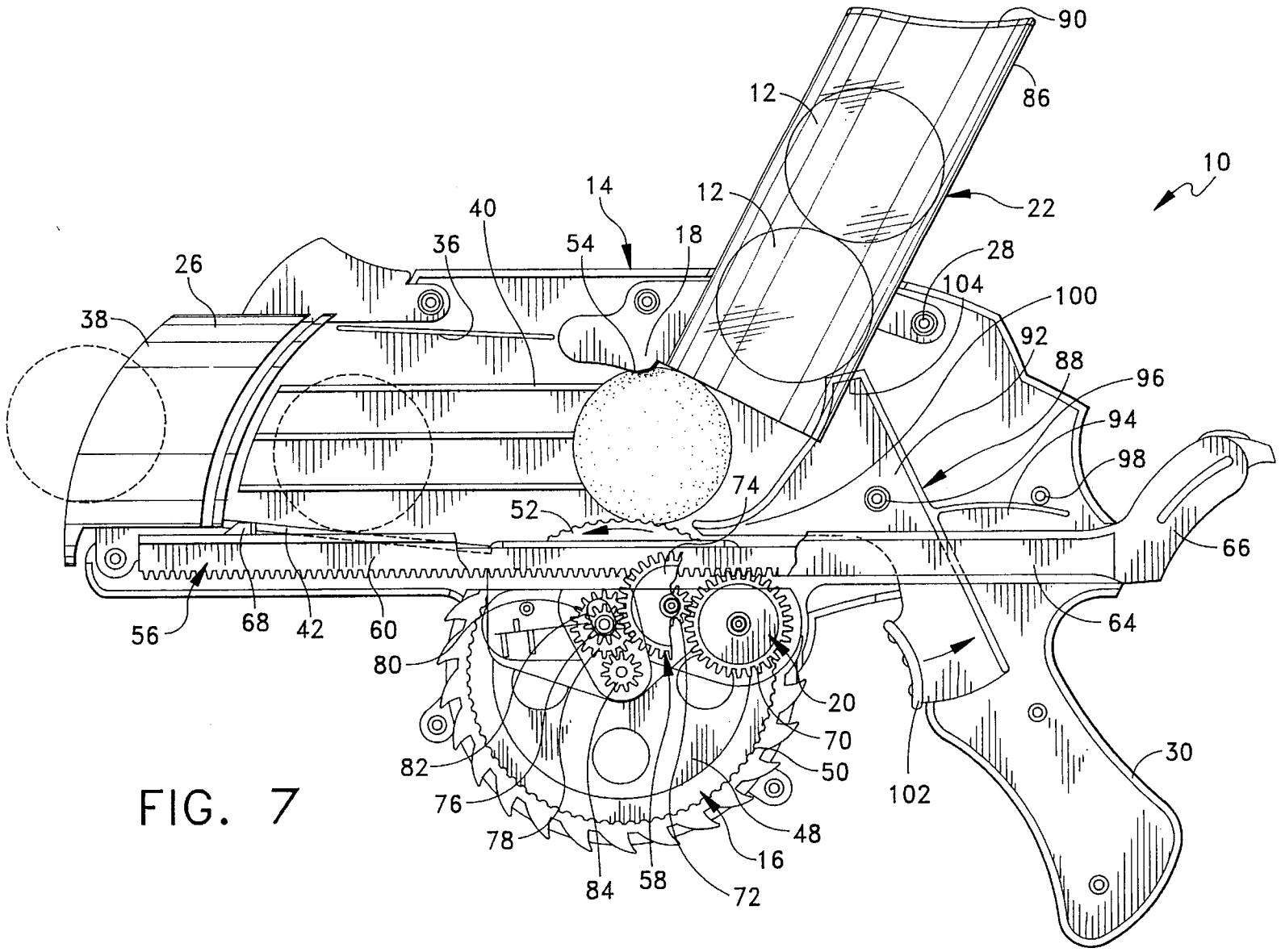
FIG. 7 is a side elevational view of the device with one side of the housing removed illustrating the operation of the device for launching a ball.

The pinion gear assembly 58 communicates with the rack gear element 56 for rotating the launching wheel 16 as the rack gear 56 is drawn rearwardly in the trackway section 32. The pinion gear assembly 58 includes a main pinion gear 70 which is mounted so that it intermeshes with the rack gear leg 60, a reduction gear 72 which intermeshes with the pinion gear 70, and a transmission gear 74 which is integrally formed in coaxial nonrotatable relation with the reduction gear 72. Also included in the pinion gear assembly 58 is a movable reduction gear 76 which is integrally formed in nonrotatable relation with a transmission gear 78. The reduction gear 76 and the transmission gear 78 are formed with a common shaft 80 which is rotatably mounted in a pair of elongated or oval-shaped mounting bosses 82 so that the gears 76 and 78 are movable between the engaged position illustrated in FIG. 4 and the disengaged position illustrated in FIG. 6. In this regard, when the gears 76 and 78 are in the engaged positions thereof, the transmission gear 78 intermeshes with a pinion gear 84 on the launching wheel 48 so that rotation is imparted to the launching wheel 48 as the gears 70, 72, 74, 76 and 78 are rotated. In this regard, rotation of the gears 70, 72, 74, 76 and 78 in the directions illustrated in FIG. 4 is normally caused by rearward movement of the rack gear element 56 in the trackway section 32, and it causes the gear 74 to move the gears 76 and 78 downwardly so that the shaft 80 travels downwardly in the mounting bosses 82, causing the transmission gear 78 to be moved into intermeshing engagement with the pinion drive gear 84. However, movement of the rack gear 56 in a forward direction causes the gears 70, 72, and 74 to be rotated in reverse directions causing the gears 76 and 78 and the shaft 80 to be moved upwardly in the mounting bosses 82 so that the transmission gear 78 is disengaged from the pinion drive gear 84. As a result, when the rack gear element 56 is drawn rearwardly in the trackway section 32, the transmission gear 78 causes the drive gear 84 and the launching wheel 48 to be rotated, whereas when the rack gear 56 is returned or moved in a forward direction in the trackway section 52, the transmission gear 78 is disengaged from the pinion drive gear 84 so that the launching wheel 16 continues to rotate without having a reverse rotational force applied thereto.

The feed assembly 22 comprises a feed tube, or magazine, 86 and a trigger member generally indicated at 88. The feed tube 86 is mounted on the housing 14 so that it extends generally upwardly from the inner end of the passage 36. The feed tube 86 has a diameter which is slightly greater than that of the balls 12 so that the balls 12 can freely gravitate downwardly therethrough. The feed tube 86 preferably further includes a restricting flange 90 at the upper end thereof which prevents the balls 12 from freely passing outwardly from the tube 86 while nevertheless permitting balls 12 to be added to the tube 86 with only a minimal amount of force.

The trigger element 88 comprises a main body portion 92 having a resilient return finger 94 formed thereon. The body portion 92 is pivotally mounted on a post 96 in the housing 14, and the return finger 94 engages a post 98, which is also formed in the housing 14, for applying a returning force to the trigger element 88 which normally returns it to the position illustrated in FIG. 3. When the trigger element 88 is in this position, a retaining arm portion 100 thereof operates to retain the lowermost ball 12 in the feed tube 16 so that the lowermost ball 12 is prevented from passing onto the launching wheel 16. However, by drawing a trigger portion 102 of the trigger element 88 in a rearward direction toward the handle portion 30, the retaining arm portion 100 is lowered so that the lowermost ball element 12 can pass onto the launching wheel 16 for launching it from the device 10. However, at the same time as the retaining arm 100 is pivoted downwardly to release the lowermost ball 12, a shoulder portion 104 of the trigger element 88 is moved into the path of the next sequential ball 12 to prevent it from also passing downwardly onto the launching wheel 16. When the trigger element 88 is thereafter returned to its initial or forward position by releasing the trigger portion 102, the next sequential ball element 12 is allowed to gravitate downwardly onto the retaining arm 100 so that it is in position to gravitate onto the launching wheel 16 when the trigger element 88 is again operated by drawing the trigger portion 102 rearwardly.

Accordingly, for use in operation of the device 10, a plurality of the ball elements 12 are fed into feed tube 86, and thereafter, the rack gear assembly 20 is operated to rotate the launching wheel 16. This is accomplished by repeatedly drawing the rack gear element 56 rearwardly and then advancing it forwardly until the launching wheel 16 has reached a high rate of rotation. Finally, when the launching wheel 16 has reached a high rate of rotation, the trigger portion 102 can be drawn rearwardly toward the handle portion 30 causing the lowermost ball element 12 to be released from the retaining arm 100 and passed onto the launching wheel 16. As the ball element 12 passes onto the launching wheel 16, it is compressed against the launching wheel 16 by the restriction 18 and therefore accelerated toward the muzzle end 38 of the passage 36 causing the ball element 12 to pass outwardly from the housing 14. Assuming that the launching wheel 16 still has sufficient rotational inertia, the trigger element 88 can again be operated in a similar manner to launch one or more additional ball elements 12 from the housing 14 in a similar manner.

It is seen, therefore, that the instant invention provides an effective ball launching device. The device 10 is adapted to be easily held in a hand of a user so that the user can effectively rotate the launching wheel 16 to a high rate of rotation utilizing the rack gear assembly 20. The trigger element 88 can then be operated to launch the balls 12 from the device 10 so that they are rapidly launched through the muzzle end 38. Hence, it is seen that the ball launching device 10 represents a significant advancement in the toy art which has both significant play value and substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A ball launching device for launching a spherical soft, foam ball, said ball having a diameter, said device comprising:

a. a launcher body having an elongated launching passage therein, said passage having a cross-sectional dimension which is slightly greater than said ball diameter and terminating in an open muzzle end;

b. a launching wheel having a circumferential gripping surface thereon which extends slightly into said passage;

c. restriction means for restricting said passage, said restriction means extending into said passage at a location which is substantially opposite from said launching wheel and terminating in an inner end which is spaced from the gripping surface of said launching wheel by a distance which is slightly less than said ball diameter;

d. manually operable rack gear means for rotating said launching wheel in a direction such that the portion of said gripping surface which extends into the launching passage travels in a launching direction which extends toward the muzzle end of said launching passage;

e. means for feeding said ball to said passage so that when said launching wheel is rotating in said launching direction, said ball is accelerated by said launching wheel as it passes between said launching wheel and said restriction means and said ball is thereby launched from said passage through said muzzle end.

2. In the ball launching device of claim 1, said rack gear means including an elongated rack gear and being operable by manually pulling said rack gear in a direction substantially opposite from said muzzle end for rotating said launching wheel.

3. In the ball launching device of claim 2, said rack gear means being operable by manually repeatedly reciprocally pulling said rack gear in a direction opposite from said muzzle end and then returning said rack gear in a direction toward said muzzle end for increasingly rotating said launching wheel during each pulling stroke.

4. In the ball launching device of claim 1, said launcher body including a pistol grip handle for enabling a user to hold said launching device in a pistol-like manner with said muzzle end facing generally away from the user.

5. In the ball launching device of claim 4, said means for feeding said ball including trigger means along said handle, said trigger means being manually operable for releasing said ball so that it passes into said passage.

6. The ball launching device of claim 1 further comprising a plurality of said balls, said means for feeding said balls, including an elongated tubular member for receiving a plurality of said balls therein, and means for individually releasing said balls so that they individually pass into said passage and between said launching wheel and said compression finger.

7. In the ball launching device of claim 6, said launcher body including a pistol grip handle for enabling a user to hold said launching device in a pistol-like manner with said muzzle end facing away from the user.

8. In the ball launching device of claim 7, said means for feeding said ball including trigger means along said handle, said trigger means being manually operable for individually releasing said balls so that they pass into said passage.

9. In the ball launching device of claim 1, said restriction means comprising a compression finger extending into said passage for compressing said ball as said ball passes between said launching wheel and said compression finger.

* * * * *